United States Patent [19]

Salzgeber

[11] 4,142,499

[45] Mar. 6, 1979

[54] TEMPERATURE COMPENSATED FUEL INJECTION PUMP

[75] Inventor: Daniel E. Salzgeber, Windsor, Conn.

[73] Assignee: Stanadyne, Inc., Windsor, Conn.

[21] Appl. No.: 838,314

[22] Filed: Sep. 30, 1977

[51] Int. Cl.[2] ..... F02D 1/04

[52] U.S. Cl. ..... 123/140 J; 123/140 MC

[58] Field of Search ..... 123/140 J, 140 R, 140 MC

[56] References Cited

U.S. PATENT DOCUMENTS

| | | | |
|---|---|---|---|
| 3,973,542 | 8/1976 | Shum | 123/140 J |
| 4,038,958 | 8/1977 | Susuki | 123/140 J |

*Primary Examiner*—Alan Cohan

*Attorney, Agent, or Firm*—Prutzman, Kalb, Chilton & Alix

[57] ABSTRACT

A fuel injection pump for an internal combustion engine having an engine speed responsive governor for adjusting the metering valve of the pump. In order to control the idle speed of the engine under varying temperature conditions a bimetal spring is interposed between the governor and the idle spring. The governor spring assembly includes a preloaded compression spring which prevents the governor from controlling the metering valve above the idle speed range until a predetermined speed is reached.

11 Claims, 6 Drawing Figures

TEMPERATURE COMPENSATED FUEL INJECTION PUMP

The present invention relates to fuel pumps conventionally employed for supplying sequential measured charges of fuel to an associated internal combustion engine and more particularly to such a pump for an engine of the compression-ignition type.

When fuel injection pumps of the type involved in this invention are used in automotive applications, the temperature to which the fuel pump may be subjected varies from a level substantially higher than the normal ambient temperature to a level substantially lower than 0° F. It has been found that both extremely high and extremely low temperatures affect the preset idle speed at which the engine operates. It is desirable that the idle speed of an engine be uniform under all temperature conditions since too high a speed will cause the car to creep forward where the automobile has an automatic transmission, and too low an idle speed will cause the engine to stall, particularly when the engine is suddenly slowed down, as frequently occurs in highway traffic. A principal object of this invention is to provide a solution to these problems.

Another object of this invention is to provide a fuel injection pump having an improved governing arrangement whereby the idle speed is maintained regardless of the variation in the operating conditions to which the pump is subjected. Included in this object is the provision of an arrangement in which the selected idle speed is repeatable.

Still another object of this invention is to provide a governing system for a fuel injected engine wherein the throttle pedal movement substantially duplicates that of a carburetor-type engine.

Another object of this invention is to provide an improved fuel injection pump having a governor wherein the maximum speed of the engine is fixed at a relatively constant level regardless of the position of the foot pedal. Included in this object is the provision of an arrangement wherein the maximum speed of the engine is substantially constant from pump to pump regardless of manufacturing variations and tolerances in the fabrication of the pumps.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the way in which the principles of the invention are employed.

Figure 1:
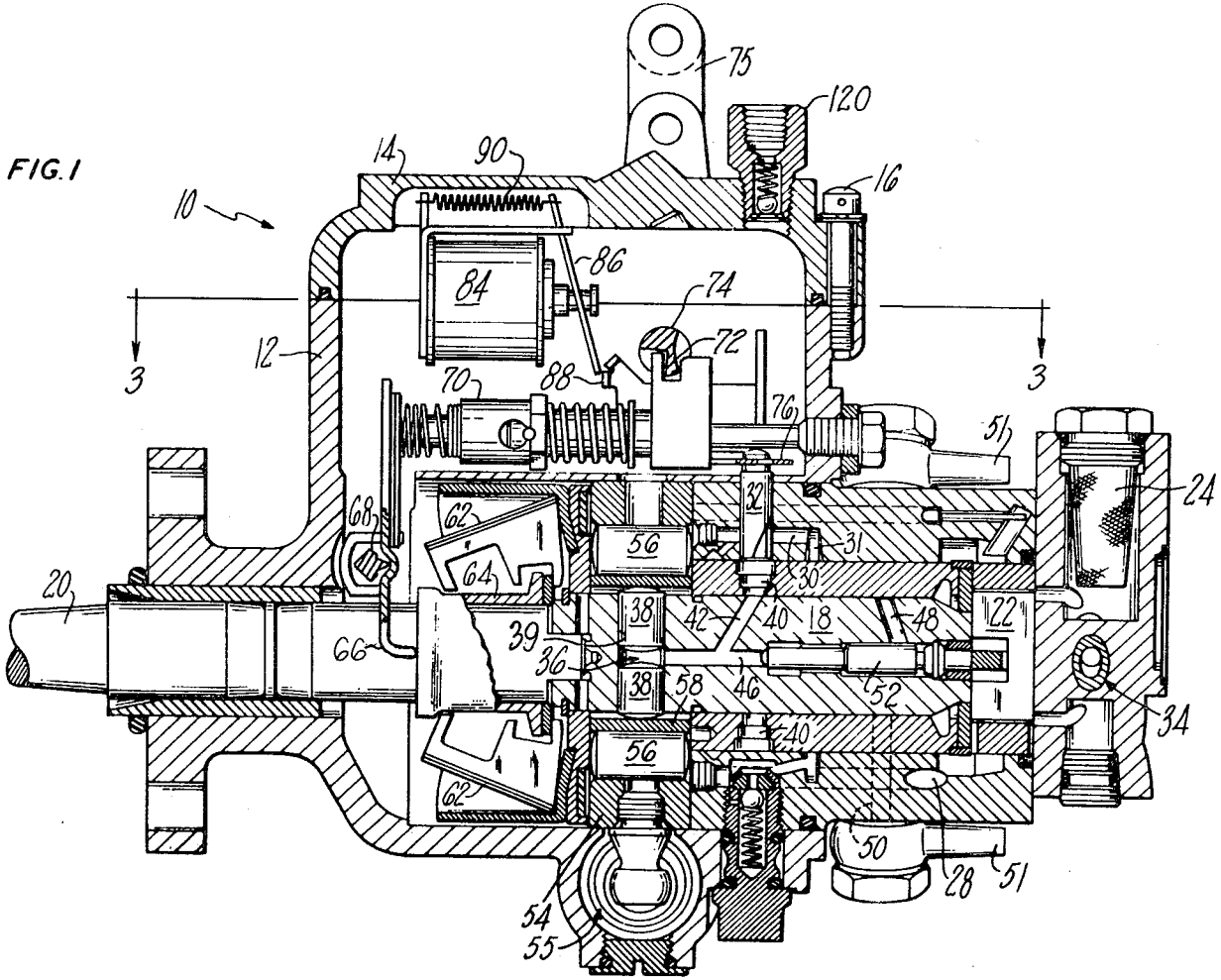
FIG. 1 is a longitudinal side elevational view, partly in section and partly broken away, of a fuel injection pump illustrating a preferred embodiment of the present invention.

Referring now to the drawings in detail, the fuel pump exemplified by the present invention is shown to be of the type adapted to supply sequential measured pulses or charges of fuel under high pressure to the several fuel injection nozzles of an internal combustion engine. The pump has a housing 12 provided with a cover 14 secured thereto by fasteners 16. A fuel distributing rotor 18 having a drive shaft 20 driven by the engine is journaled in the housing.

A vane-type transfer or the low pressure supply pump 22 is driven by the rotor 18 and receives fuel from the reservoir (not shown) through pump inlet 24. Its output is delivered under pressure via axial passage 28, annulus 31 and passage 30 past a metering valve 32. A transfer pump pressure regulating valve, generally denoted by the numeral 34, regulates the output pressure of the transfer pump and returns excess fuel to the pump inlet 24. The regulator 34 is designed to provide transfer pump output pressure which increases with engine speed in order to meet the increased fuel requirements of the engine at higher speeds and to provide a fuel pressure usable for operating auxiliary mechanisms of the fuel pump.

A high pressure charge pump 36 comprising a pair of opposed plungers 38, mounted for reciprocation in a diametral bore 39 of the rotor, receives metered fuel from the metering valve 32 through a plurality of angularly spaced radial ports 40 (only one of which is shown) adapted for sequential registration with a diagonal inlet passage 42 of the rotor as the rotor 18 is rotated.

Fuel under high pressure from the charge pump 36 is delivered through an axial bore 46 in the rotor to a distributing passage 48 which registers sequentially with a plurality of angularly spaced outlet passages 50 (only one of which is shown) which in turn communicate respectively with the individual fuel injection nozzles of the engine through discharge fittings 51 spaced around the periphery of the housing 12. A delivery valve 52 in the axial bore 46 operates to achieve sharp cut-off of fuel to the nozzles to eliminate fuel dribble into the engine combustion chambers.

The inlet passages 40 are angularly located around the periphery of the rotor 18 to provide sequential registration with the diagonal inlet passage 42 during the intake stroke of the plungers 38, and the outlet passages 50 are similarly located to provide sequential registration with the distributor passage 48 during the compression stroke of the plungers.

An annular cam ring 54 having a plurality of pairs of diametrically opposed cam lobes is provided for actuating the charge pump plungers 38 inwardly for pressurizing each charge of fuel. A pair of rollers 56 and roller shoes 58 are mounted in radial alignment with the plungers 38 for camming the plungers inwardly. For timing the distribution of fuel to the nozzles in correlation with engine operation, the annular cam ring 54 may be angularly adjustable by a suitable timing piston 55 which is connected to the cam ring by a connector 57.

A plurality of governor weights 62 spaced about pump shaft 20 provide a variable bias on a sleeve 64, slidably mounted on shaft 20. The sleeve engages pivoted governor plate 66 to urge it clockwise (as viewed in FIG. 1) about a supporting pivot 68. The governor plate is urged in the opposite pivotal direction by a governor spring assembly 70, the axial position of which is adjustable by a cam 72 operated by shaft 74 which is connected to the throttle arm 75. The throttle arm in turn is connected to the controlling foot pedal in the driver's compartment of the automobile.

The governor plate 66 is connected to control the angular position of the metering valve 32 through control arm 76 which is fixed to the metering valve and by a drive link 78 which is pivotally connected to control arm 76 and is normally held in engagement with governor plate 66 by tension spring 82, the ends of which are connected to drive link 78 and governor plate 66, respectively. The drive link 78 is provided with a pin 77 received in a slot (not shown) in a tab 79 of the governor plate to provide a lost motion connection between the governor plate and the drive link 78.

An electric solenoid 84 has a flapper arm 86 which engages an ear 88 on drive link 78 to hold the metering valve 32 closed under the bias of a spring 90 except when the solenoid is energized.

As well known, the quantity or measure of the charge of fuel delivered by the charge pump in a single pumping stroke is readily controlled by varying the restriction offered by the metering valve 32 to the passage of fuel therethrough. Thus, the angular position of the metering valve controls the speed of the associated engine and the centrifugal force of the governor fly weights may be used to urge the metering valve 32 clockwise, as shown in FIG. 3, thereby to increase the restriction to the flow of fuel past the metering valve if speed begins to increase.

The pump thus far described is a conventional pump found in the prior art.

Figure 2:
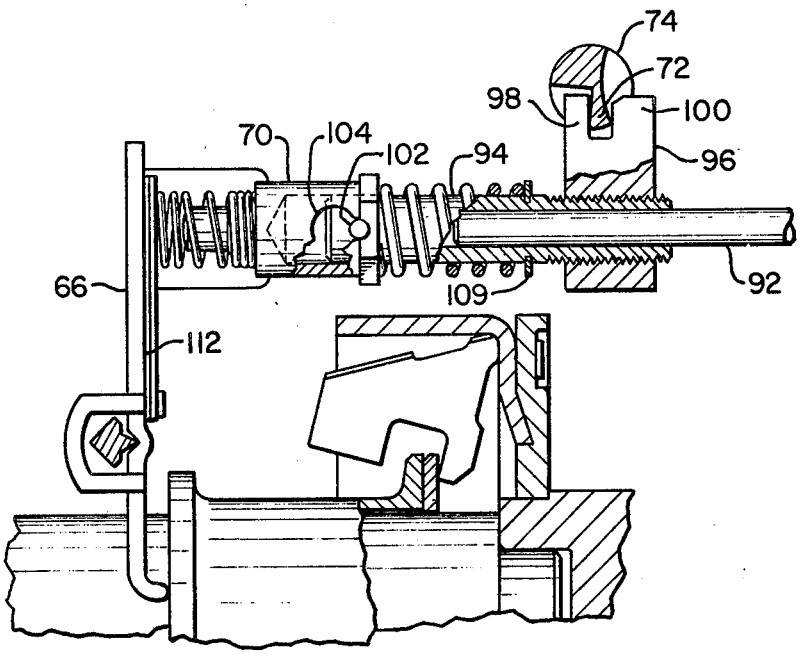
FIG. 2 is an enlarged fragmentary cross-sectional view of the governor of the pump of FIG. 1.
Figure 3:
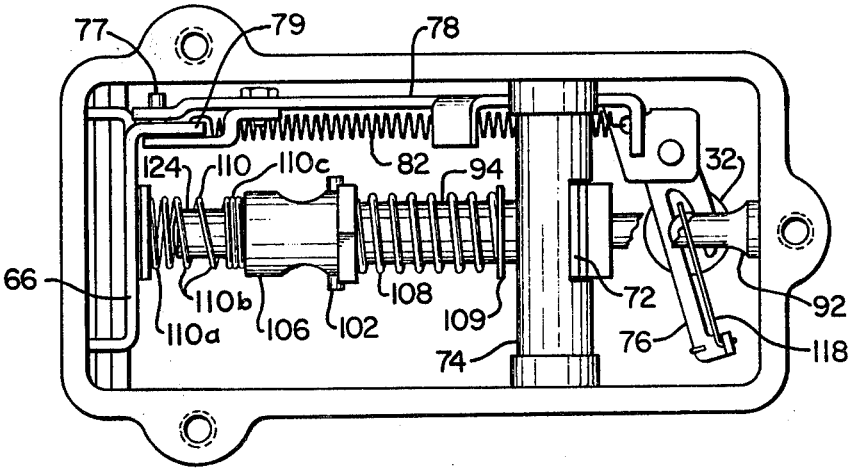
FIG. 3 is an enlarged fragmentary top plan view taken along the line 3—3 of FIG. 1.

Referring now particularly to FIGS. 2 and 3, the illustrated embodiment of the pump incorporating the present invention is provided with a governor which automatically regulates the engine speed in the idle speed range and at maximum speed with the metering of fuel at intermediate speeds being controlled solely by the mechanical actuation of the throttle foot pedal.

As best shown in FIGS. 2 and 3, the governor spring assembly 70 includes an axial guide stud 92 fixed to an end wall of the pump housing 12. A cylindrical push rod 94 is provided with the central bore which slidably receives the guide stud 92. An upstanding throttle block 96 having a bifurcated upper end threadably engages the push rod 94 for the axial adjustment thereof, with the bifurcated ends 98, 100 straddling the throttle cam 72.

A radially projecting pin 102, fixed to the push rod 94, is received in an elongated aperture 104 of sleeve 106 which is slidably mounted over the push rod 94. A compression spring 108 surrounds the push rod 94 and is provided with a split retaining washer 109 seated in a peripheral groove formed in push rod 94. Spring 108 is preloaded in compression so as to exert a biasing force against the sleeve 106 to hold the pin 102 against the right end of the slot 104, thereby to cause the sleeve 106 to move in unison with the push rod 94 until the speed of the engine reaches a predetermined maximum speed at which the axial force exerted by the governor plate exceeds the preload force of spring 108. Moreover, at the predetermined maximum speed, say, about 4200 rpm, the radii of the center of mass of the fly weights 62 will increase as the spring 108 begins to compress to increase the axial force exerted on the governor spring assembly 70 by the governor plate 66 at a rate that builds up faster than the spring force of spring 108 so that the spring 108 collapses to close the metering valve rapidly to limit the speed to the preselected maximum level, regardless of the throttle setting.

It will be apparent that the maximum speed spring 108 will not be compressed at speeds below the preset speed so that the governor sleeve 106 will be fully extended with respect to push rod 94 until the preselected speed is reached.

Sleeve 106 is provided with a cylindrical axial projection 124 at the end thereof and idle governor spring 110 is mounted thereon. Idle spring 110 is a dual rate spring having end convolutions **110*a* which are more closely spaced than the intermediate convolutions 110*b* thereof. With such a construction, a compressive force applied by the governor plate 66 on the idle spring 110 will initially be resisted by a relatively light spring force until the closely-spaced convolutions 110*a* bottom against each other at which point, say, about 800 rpm, the stiffness of the spring increases due to the reduced number of active convolutions of the spring 110 so that a greater force must be applied by the governor plate 66 to compress the spring 110 a given amount. In this manner, the idle spring 110 provides for a more uniform idle speed governing below 800 rpm, and a more sensitive throttle foot pedal feel above 800 rpm until the extension 124 of sleeve 106 engages governor plate 66. This improves the pedal feel by providing increased responsiveness of the engine with less pedal movement during the acceleration of the automobile. Moreover, by placing the idle spring between the governor plate 66 and the end of the governor spring assembly 70**, so that only the idle spring is flexed and the other components of the spring assembly do not move, the friction and inertia associated with prior designs is eliminated.

Preferably, the convolutions **110*c* engage the cylindrical extension 124 of the sleeve 106 with an interference fit to prevent rotation of the spring 110 with respect to the extension 124. This prevents a change in idle speed from the adjusted level caused by any lack of squareness of the end of the idle spring 110 which engages governor plate 66**.

It will be apparent that the idle speed may be adjusted at, say 550–600 rpm, by the threaded adjustment of the throttle block 96 on the push rod 106 to fix the idle speed equilibrium position of the metering valve 32.

It will be further apparent that by virtue of the preloaded maximum speed spring 108, a preset maximum speed may be established within a narrow speed range regardless of manufacturing variations and tolerances. Moreover, by bifurcating the upper end of the throttle block 96, it will be apparent that the governor spring assembly is positively moved to engine idle position when the throttle shaft 74 is returned to idle position regardless of any possible binding of the sliding members of the spring assembly.

Figure 4A:
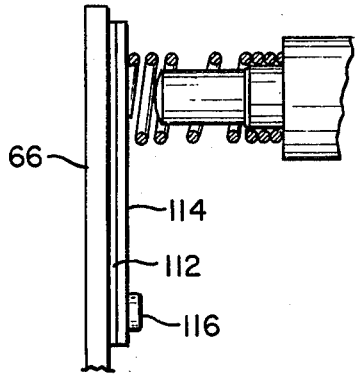
FIGS. 4*a*, 4*b* and 4*c* are enlarged fragmentary views of the temperature compensation feature of the governor of FIG. 1.
Figure 4B:
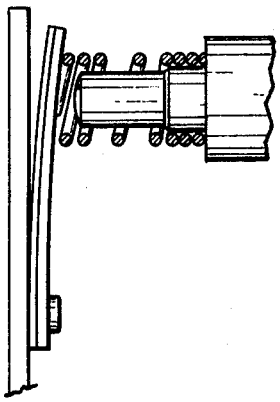

An important feature of this invention is the provision of means for substantially maintaining the consistent idle speed regardless of the ambient temperatures surrounding the pump. As shown best in FIGS. **4*a*, 4*b* and 4*c*, the governor plate 66 is connected to the governor spring assembly 70 through a pair of cantilever mounted strip members, each of which has one end secured to the governor plate 66 by a rivet 116. The strip member 112 is a bi-metal strip which lies parallel to the governor plate 66 at normal temperatures. Strip member 114 is a leaf spring which resists the bowing of the bi-metal strip 112 from its parallel position as well as to provide a bearing seat for idle spring 110. If the temperatures within the pump reach a high temperature, say 130° F., the bi-metal strip 112 will begin to bow away from the governor plate 66, as indicated in FIG. 4*b*, to increase the biasing force applied by the idle spring 110 against governor plate 66** to increase the metering valve opening thereby to compensate for the normal lessening of fuel delivery of the pump at the preset idling speed of the engine.

Figure 4C:
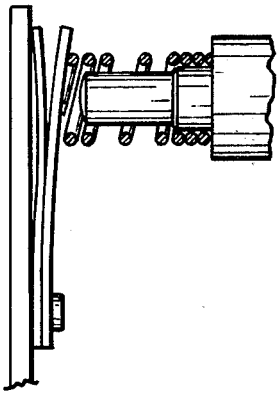

If the pump temperature drops substantially below the normal temperature range, the bi-metal strip 112 bows in the opposite direction, as indicated in FIG. 4c, to move the free end of leaf spring 114 away from the free end of the bi-metal strip 112 to again increase the biasing force applied to the idle spring to maintain or increase the idling speed of the engine at cold temperatures when combustion is less stabilized than under normal operating conditions. Thus, it will be seen that the temperature compensation means of this invention permits the setting of a low idling speed under normal temperature conditions by maintaining the idling speed of the engine at high pump temperatures and at low pump temperatures. The spring force of bi-metal strip 112 is less than the preload on spring 108 so as not to affect maximum engine speed.

Another feature of this invention is a provision of means to effectively maintain the shot-to-shot uniformity and idling speed repeatability of the delivery of fuel. As shown in FIG. 3, the metering valve control arm 76 mounts a wire-type cantilever spring 118, the free end of which engages the cylindrical top surface of the guide pin 92, preferably on the axis of rotation of the metering valve 32.

Fuel injection pumps are conventionally provided with a bleed valve 120 to remove any air which might be entrained in the fuel entering the pump, and to maintain a housing pressure of, say 8–12 pounds per square inch, within the pump.

When the metering valve 32 is almost completely closed, under high speed and low load conditions, it offers a high resistance to the flow of fuel to the charge pump and the pressure in passage 40 may become less than the pressure in the governor chamber above the metering valve. Under such circumstances, alternate communication and non-communication between the ports 40 and the passage 42 may cause axial displacement of the metering valve 32. Such displacement will add to and subtract from the quantity of fuel delivered to the charge pump 36 for different pumping strokes to produce shot-to-shot variations in the amount of fuel delivered to the several cylinders of the associated engine. In order to overcome such undesired consequences, the biasing spring 118 provides an upward spring force, which added to force produced by the pressure downstream of the metering valve in passage 40 will always exceed the downward force due to housing pressure above the metering valve thereby to prevent such pulsations. The cantilever mounted wire spring 118 is cylindrical and engages the cylindrical upper surface of the guide stud 92, essentially by point contact on the axis of rotation of the metering valve 32 and offers a very small torsional loading to resist the rotation to the metering valve. Since such loading is also uniform, the idle speed of the engine is repeatable under all operating conditions.

As will be apparent to persons skilled in the art, various modifications, adaptations and variations of the foregoing specific disclosure can be made without departing from the teachings of the present invention.

I claim:

1. In a fuel injection pump for an internal combustion engine, a metering valve adjustable in opening and closing directions for variably metering the fuel delivered by the pump to the engine, an engine speed responsive governor for adjusting the metering valve by providing an increasing force with increasing speed to urge the metering valve in its closing direction, said governor including an idle speed control spring providing a biasing force to urge the metering valve in its opening direction, and means for setting the bias of the idle spring to establish the idling speed of the engine, the improvement comprising a bi-metal means interposed between the governor and the idle spring to increase the biasing force of the idle spring as the temperature of the pump increases or decreases thereby to maintain the idle speed of the engine under widely varying temperature conditions.

2. The device of claim 1 wherein the governor includes fly weights acting through a lever to apply a variable force opposing the bias of said idle spring and wherein said bi-metal means includes a cantilever mounted strip having one end fixed to said lever with its free end interposed between said lever and said biasing spring.

3. The device of claim 2 wherein the free end of said cantilever mounted bi-metal means is positioned parallel to said lever under normal temperature conditions, and its free end bows away from said lever upon a change in the temperature in one direction to increase the biasing force of the idle spring.

4. The device of claim 3 wherein said bi-metal strip is provided with a resilient backing strip engageable with the idle spring, and the free end of said resilient backing strip is bowed away from the free end of said bi-metal upon a change in the temperature in the opposite direction to increase the biasing force of the idle spring.

5. The device of claim 1 wherein said idle spring is a dual-rate spring having a higher spring rate after it is compressed a predetermined amount.

6. The device of claim 1 wherein the idle spring is non-rotatably secured to its support, and one end thereof is engageable with said bi-metal means.

7. The device of claim 1 wherein said metering valve is rotatable and is connected to said governor through a control arm, a cantilever spring mounted by said control arm with its free end engaging an abutment to fix the axial position of said metering valve.

8. The device of claim 7 wherein said cantilever spring has its free end aligned with the axis of the metering valve.

9. In a fuel injection pump for an internal combustion engine, a metering valve adjustable in opening and closing directions for variably metering the fuel delivered by said pump to the engine, an engine speed responsive governor connected to said metering valve to urge it in its closing direction, a throttle shaft, a governor spring assembly operatively connected to said throttle shaft to act in opposition to said governor in controlling said metering valve, said governor spring assembly having a pre-loaded compression spring which prevents said speed responsive governor for controlling said metering valve above the idle speed range until a predetermined speed is reached, the pre-loaded spring having a spring rate so that the force of said governor increases faster than the spring force above said predetermined speed to fix the maximum speed of engine operation regardless of the throttle setting.

10. The device of claim 9 wherein the connection between said throttle shaft and said governor spring assembly drives the governor spring assembly in both directions to positively move it to its idle position whenever the throttle shaft is rotated to idle position.

11. The device of claim 9 including bi-metal means to assist the governor spring assembly in opposing the governor in controlling the metering valve, the force of said bi-metal means being less than the preload of said compression spring so that the maximum speed of the engine is unaffected by temperature changes.

* * * * *

UNITED STATES PATENT AND TRADEMARK OFFICE

CERTIFICATE OF CORRECTION

PATENT NO. : 4,142,499

DATED : March 6, 1979

INVENTOR(S) : Daniel E. Salzgeber

It is certified that error appears in the above-identified patent and that said Letters Patent are hereby corrected as shown below:

Claim 9, line 51, change "for" to --from--

Signed and Sealed this

*Twenty-fourth* Day of *July 1979*

[SEAL]

*Attest:*

*Attesting Officer*

LUTRELLE F. PARKER

*Acting Commissioner of Patents and Trademarks*